United States Patent [19]

Chia-Hsi

[11] Patent Number: 4,744,423

[45] Date of Patent: May 17, 1988

[54] PIEZOELECTRIC HIGH VOLTAGE IMPACT MECHANISM

[75] Inventor: Yen Chia-Hsi, Taichung, Taiwan

[73] Assignee: Tri Square Industrial Co., Ltd., Taichung, Taiwan

[21] Appl. No.: 844,382

[22] Filed: Mar. 26, 1986

[51] Int. Cl.[4] ..... B25D 9/00

[52] U.S. Cl. ..... 173/90; 173/117; 173/122

[58] Field of Search ..... 173/90, 91, 122, 117

[56] References Cited

U.S. PATENT DOCUMENTS 4,300,282 11/1981 Bunyen et al. ..... 173/117 X 4,305,736 12/1981 Kahl et al. ..... 173/117 X

*Primary Examiner*—E. R. Kazenske

*Assistant Examiner*—Willmon Fridie, Jr.

*Attorney, Agent, or Firm*—Arnold, White & Durkee

[57] ABSTRACT

The present invention relates to a new and improved piezoelectric high voltage impact mechanism including a hollow housing means having groove means with two portions and a shoulder portion at their juncture, provided on its inner surface, an actuator means having two projections slidably received in the upper portion of the groove means, a hammer means with two lug members movably received in the lower portion of the groove means and an actuating spring means torsionally connecting the actuator means and the hammer means so that the hammer is held on the shoulder in the housing as actuation is initiated. Energy is stored in the spring during actuation and the actuator pushes the hammer off the shoulder, initiating an impact in a straight-line avoiding unnecessary dispersal of energy and ensuring a stable high voltage pulse.

11 Claims, 3 Drawing Sheets

PIEZOELECTRIC HIGH VOLTAGE IMPACT MECHANISM

BACKGROUND OF THE INVENTION

The present invention relates to a piezoelectric high voltage device, particularly concerning an improvement on the impact mechanism of the device in which the piezoelectric element is essentially struck by a straight-line directional force. This improvement has operational and economic advantages over prior art devices.

Piezoelectric high voltage devices of both impact type and gradual squeeze type are known in the prior art. The impact type devices have a considerable cost advantage over squeeze devices as less bulky arrangements are required in order to provide the necessary force, and dimensional tolerances are much less regid.

The impact type device of the prior art consists of housing means, which contains actuator means, ledge means contained within the housing means, actuator means contained within the housing means having a blind bore formed therein, an hammer means receivable in the housing means, an actuating spring means received within the blind bore and operably connected to the hammer means, and piezoelectric element means received in the housing which is responsive to mechanical actuation thereof to produce a spark.

The blind bore in the actuator means has a longitudinal axis offset from the longitudinal axis of the actuator means causing the actuating spring means and the hammer means to be positioned at an angle offset from the longitudinal axis of the housing means. This results in the engagement of the hammer means with the ledge means upon the inward movement of the actuator means in the housing means. During actuation of the mechanism, the actuating spring means is compressed as the hammer means is held on the ledge means by the offset position of the actuating spring means and is released as the actuator means forces the hammer means off the ledge means. The actuating spring then expands, throwing hammer against the piezoelectric element means to generate a high voltage pulse.

In the above-mentioned arrangement, the actuator means has slanted internal walls that hold the actuating spring means at an angle so that the hammer means is held by actuating spring means on internal ledge means before actuation.

Such an arrangement has a disadvantage that undesirable component or disperse forces may result and reduce the impact speed of the hammer against the piezeoelectric element means. Therefore, the high voltage pulse may vary from one impact to another impact. Also the piezoelectric element means is easily damaged under such unstable impact conditions, and frequent replacement of the device is costly.

SUMMARY OF THE INVENTION

With the above problems in mind, the main object of the invention is to provide a novel piezoelectric high voltage impact mechanism of which actuating spring is held in a straight line position and which exerts the necessary force on the piezeoelectric element means directly.

The present invention addresses the cost problem of piezoelectric high voltage impact mechanisms by providing a device with fewer parts and easier assembly than prior art devices.

An object of the invention is to provide an improved piezoelectric high voltage impact mechanism which causes a stable high voltage pulse under each impact operation.

Another object of the invention is to provide an improved piezoelectric high voltage impact mechanism having a novel retaining arrangement of the actuating spring and the hammer means which results in a straight-forward smooth impact against the piezoelectric element means upon releasing of the hammer means from its initial retained position.

A further object of the invention is to provide an improved piezoelectric high voltage impact mechanism which provides a guiding groove for the actuator means and the hammer means to slide smoothly in the housing means along the groove.

A still further object of the invention is to provide an improved piezoelectric high voltage impact device of which the actuator means has wedge-shaped projecting means and hammer means has lug members each with an inclined portion, wherein each of the inclined portions of the wedge-shaped projecting means is in an arrangement to engage with each of the inclined portions of the lug members respectively when an external force is put on the actuator means, to release the lug members from the shoulder portion of the groove.

In order to achieve the aforesaid objects as well as other incidental objects and advantages, the invention includes a housing means having an inner groove with two portions, which includes a shoulder portion at juncture of the two portions, and an actuator means having a blind bore formed therein, slidably provided in one of the two groove portions, having projecting means extending axially from one end of the actuator means received in said one portion of the groove.

A hammer means with lug members is movably received in another portion of the groove. The hammer means includes a head portion and an upward elongated tail portion, wherein the two lug members are provided on the periphery of the head portion at diametrically opposite positions.

The actuator means further includes a spring retainer provided in the blind bore and the head portion of the hammer means further includes a slot provided on the head portion between the two lug members.

An actuating spring means includes a radially bent portion at one of its ends and an axially bent portion at its other end, which ends are retained in the spring retainer of the blind bore and the slot of the hammer respectively. The actuating spring means is torsionally and axially received in the blind bore and connected with the hammer means to result in the engagement of the lug members of the hammer means with the shoulder portion by the biasing action of the torsioned actuating spring means. The projecting means of the actuator means includes two wedge-shaped projections at diametrically opposite positions which can engage with the inclined portion of the lug members.

The invention further includes piezoelectric element means received in the housing which responds to mechanical actuation thereof to produce a spark.

During actuation of the mechanism, the actuating spring means, which is torsionally received in the blind bore of the actuator means as the lug member of the hammer means is held on the shoulder portion due to the torsion of the actuating spring means, is released as the projections of the actuator means forces the lug members off the shoulder portion and causes the hammer strike on the piezoelectric element means in a straight forward direction.

The invention further includes a return spring means which, after actuation of the mechanism, causes the lug members to return to their original positions engaged with the shoulder portions so that the piezoelectric mechanism is prepared for another actuation.

BRIEF DESCRIPTION OF THE DRAWINGS

These and other advantages, objects and features of the present invention will become apparent from the following detailed description of the preferred embodiment with reference to the accompanying drawings, wherein.

DETAILED DESCRIPTION OF THE PREFERRED EMBODIMENT

The following is a detailed description of the best presently contemplated embodiment of the invention. This description is not to be taken in a limiting sense, but is made merely for the purpose of illustrating the general principles of the invention.

Figure 1:
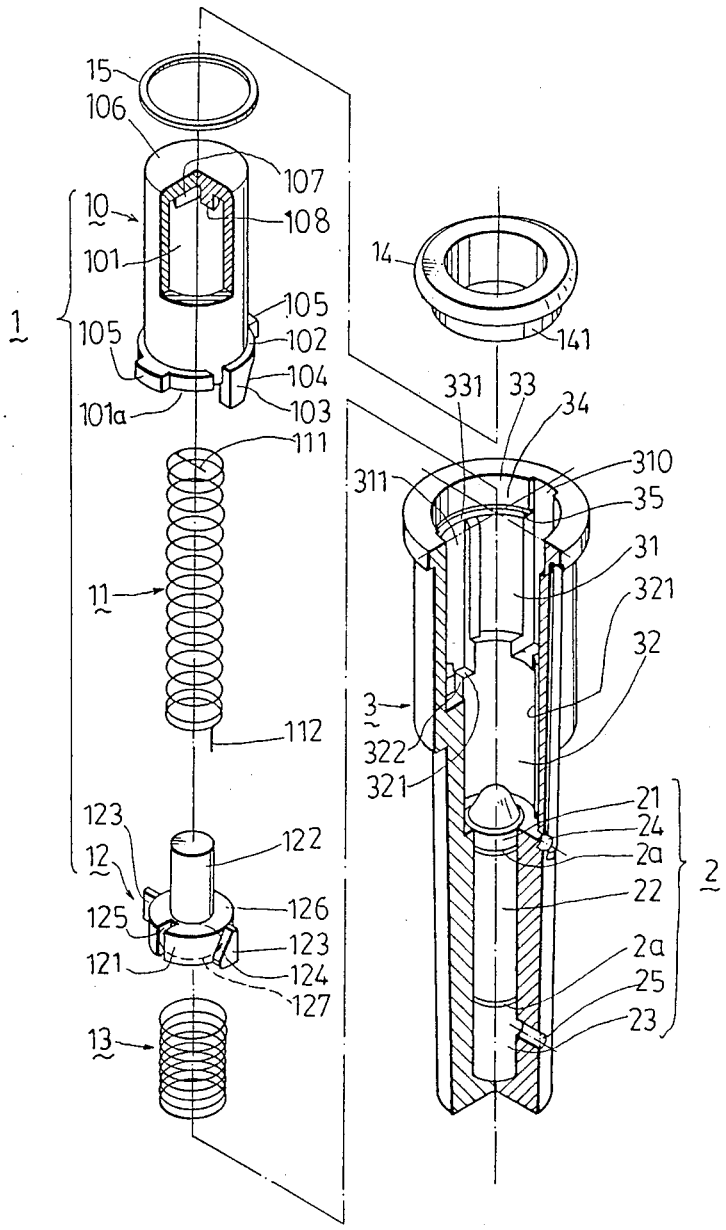
FIG. 1 is an exploded view of a preferred embodiment according to the invention.
Figure 2:
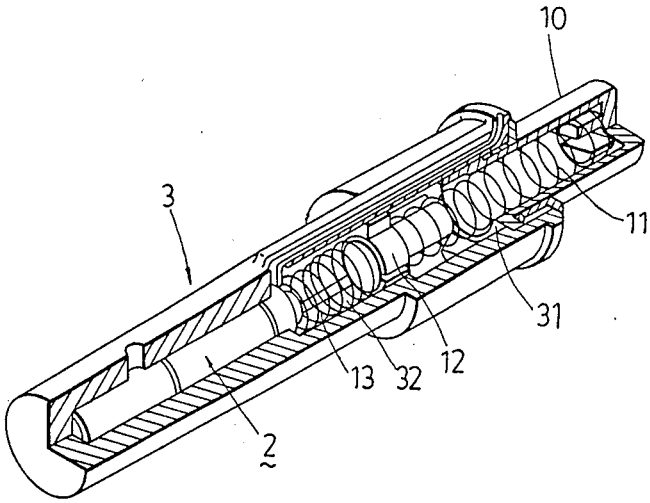
FIG. 2 is a partial cross-sectional view of the invention showing the inner arrangement of all the elements received in the housing means before actuation.

Referring to FIG. 1 in conjunction with all remaining Figs., the invention includes an impact mechanism 1 and a piezoelectric element means 2 which are received in a housing means 3.

The housing means 3 is in a two-stepped hollow cylindrical shape with a large-dimension inner hollow portion 31 at the upper portion of the housing means 3 and a small-dimension inner hollow portion 32 at the bottom portion of the housing means 3. The piezoelectric element means 2 is received in the lower end of the small-dimension portion 32 of the housing means 3. Two first grooves 311 are provided in the inner wall of the large-dimension hollow portion 31 at diametrically opposite positions. Another two second grooves 322 are provided on the inner wall of the small-dimension hollow portion 32 communicating respectively with the two first grooves 311. A shoulder portion 321 is formed at the juncture of the groove 311 and 322. Two third grooves 310 are provided on the inner wall of the large-dimension hollow portion 31 at diametrically opposite positions between the two first grooves 311.

The piezoelectric element means 2 includes a front metallic adjacent end means 21, piezoelectric element 22 and a back metallic adjacent end means or anvil means 23. The piezoelectric element 22 is disposed between the two metallic adjacent end means 21, 23. Aluminum plates 2*a* are sandwiched between the metallic adjacent end means 21, 23 and piezoelectric element 22. Electrical connection is provided by terminal means 24, 25.

The impact mechanism 1 includes an actuator means 10, an actuating spring means 11, a hammer means 12 and a return spring means 13. The actuator means 10 has a blind bore 101 with an open end 101*a* and a closed end portion 106 formed therein. Two wedge-shaped projections 103 extend axially from the outer portion of the actuator means 10 at the open end 101*a* and are provided at diametrically opposite positions in the actuator means 10. The projection 103 has a first inclined portion 104. Two protrusions 105 provided on the outer periphery of the opening 101*a* are set between the two projections 103. The two projections 103 and the two protrusions 105 can be slidably received in the grooves 311 and 310 respectively. A retainer 108 with a slot 107 is provided in the inner wall of the closed end portion 106 of the blind bore 101.

The hammer means 12 includes a head portion 121 and an upward elongated tail portion 122. Two lug members 123 having a second inclined portion 124 are provided on the periphery of the head portion 121 at diametrically opposite positions. A slot 125 is provided axially on the periphery of the head portion 121 between the two lug members 123. The two lug members are movably received in the second grooves 322. A protrusion 127 is provided on the head portion 121.

An actuating spring means 11 includes a radially bent portion 111 at one of its end and an axially bent portion 112 at the other end. The actuating spring means 11 is torsionally and axially received in the actuator means 10 and is connected with the hammer means 12 so that the radially bent end 111 and the axially bent end 112 of the spring means 11 are received in the slot 107 of the actuator means 10 and the axial slot 125 of the hammer means 12 respectively so the the lug members 123 of the hammer means 12 can engage with the shoulder portion 321 when the hammer means 12 is in its initial position due to the biasing action of the torsioned actuating spring means 11. A return spring 13 is provided between the piezoelectric element means 2 and the hammer 12 in the housing means 3.

The housing means 3 further includes an opening 33 of which the dimension is larger than the inner dimension hollow portion 31 so that a step portion 331 is formed between them. An annular groove 35 is provided at the upper edge of the step portion 331 for receiving a ring member 15. A washer 14 with tail portion 141 for retaining the actuator means 10 is received in the opening 33 of the housing means 3 and the outer portion of the tail portion 141 of the washer 14 can be fixed to the inner wall 34 of the opening 33 by an adhesive resin.

Figure 3:
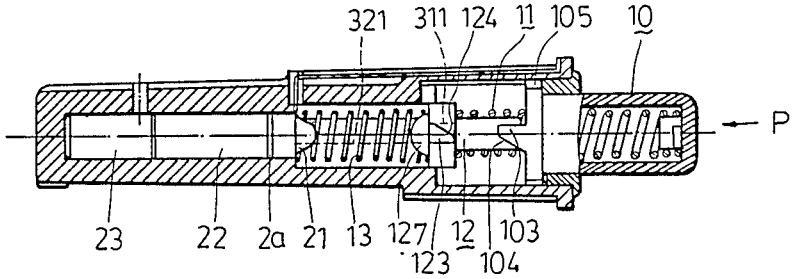
FIG. 3 is a cross-sectional view of FIG. 2 showing the hammer means held in its initial position before a force is applied to the actuator means.

Operation of the high voltage piezoelectric mechanism 1 will now be described in detail. FIG. 3 shows the rest position of the device where the lug members 123 of the hammer means 12 are held on the shoulder portion 322 of the grooves 311, 322.

Figure 4:
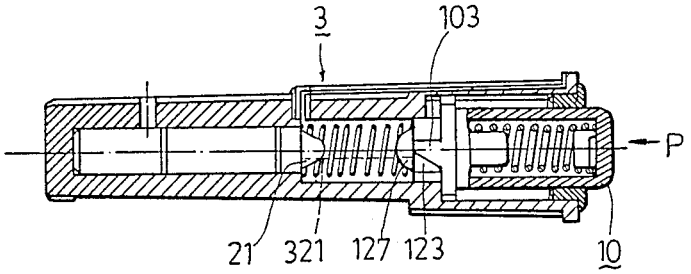
FIG. 4 is a cross-sectional view of the invention showing the projections on the actuator means engaged with the hammer means when an external force is applied to the actuator means.
Figure 5:
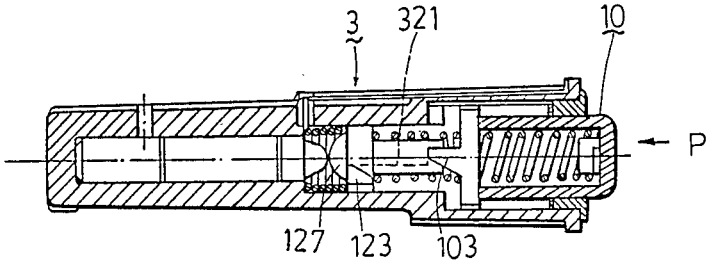
FIG. 5 is a cross-sectional view of the invention showing the hammer means released from the shoulder portion and exterting force directly against the piezoelectric element means to cause a high voltage pulse after an external force has been applied to the actuator means.

If an external force P is inserted on the actuator means along the direction indicated by the arrow in FIGS. 3–5, the actuating spring means 11 is compressed as the hammer means is held on the shoulder portion 321 till the projections 103 reaches the lug members 123. The inclined portions 104 of the projections 103 push the inclined portion 124 of the lug members (see FIG. 4) causing the hammer 12 to be released from the shoulder 321. Actuating spring 11 then expands, throwing hammer 12 so that the hammer 12 slides smoothly along the grooves 322 and directly hits the front metallic adjacent end 21. (See FIG. 5). Return spring 13 resists the hammer 12, but it is much more flexible than that of actuating spring means 11. The blow imparted to front adjacent end 21 causes an elastic wave to pass through piezoelectric element 22 generating a high voltage pulse between terminal means 24, 25.

Return spring 13 then pushes hammer means 12 against actuating spring means 11, which pushes actuator means 10, all these parts moving upward until the initial rest position is again established so that the piezoelectric mechanism is prepared for another actuation. While the torsioned actuating spring means 11 is being pushed upward, the actuator means 10 will not rotate due to the biasing force of the torsioned spring means 11 because the protrusions 105 of the actuator means 10 are received in the grooves 310.

While this invention has been described with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures.

What I claim is:

1. An improved piezoelectric high voltage impact mechanism comprising:

a housing means having an axial inner groove means with two portions a first portion and a smaller second portion; said two portions forming a shoulder portion at their juncture;

an actuator means slidably provided in one of said two groove portions having projecting means extending axially from one end of said actuator means received in said first portion of said groove; said actuator means having a blind bore formed therein;

a hammer means having lug members movably received in said second smaller portion of said groove means;

piezoelectric element means received in said housing, said piezoelectric element means responsive to mechanical actuation thereof to produce a spark;

an actuating spring means received within said blind bore and operably connected to said hammer means; wherein said actuating spring means is torsionally and axially received in said blind bore and connected with said hammer means to result in the engagement of said lug members of said hammer means with said shoulder portion by the biasing action of the torsioned actuating spring means, and wherein said actuating spring means exerts force directly on said hammer means causing it to strike said piezoelectric element means in a straight-line direction when said lug members are pushed by said projecting means of said actuator means upon the inward movement of said actuator means in said housing means.

2. An improved piezoelectric high voltage impact mechanism as claimed in claim 1, wherein said projecting means has two wedge-shaped projections at diametrically opposite positions on the outer periphery of said actuator means.

3. An improved piezoelectric high voltage impact mechanism as claimed in claim 2, in which said hammer means includes a head portion and an upward elongated tail portion, wherein said lug members are provided on the periphery of said head portion at diametrically opposite positions and each has an inclined portion which can be engaged with the inclined portion of said wedge-shaped projections upon the inward movement of said actuator means.

4. An improved piezoelectric high voltage impact mechanism as claimed in claim 1, wherein said actuator means further includes a spring retainer provided in said blind bore.

5. An improved piezoelectric high voltage impact mechanism as claimed in claim 3, wherein said head portion of said hammer means further includes an axially extending slot provided between said lug members.

6. An improved piezoelectric high voltage impact mechanism as claimed in claim 4 or 5, wherein said actuating spring means includes a radially bent portion at its one end and an axially bent portion at its other end, which are received in said spring retainer and said axially extending slot respectively as said actuating spring means is torsionally received in said actuator means.

7. An improved piezoelectric high voltage impact mechanism as claimed in claim 1, wherein during actuation of said mechanism, said actuating spring means is torsionally received in said blind bore of actuator means as said lug members of said hammer means are held on said shoulder portion due to the torsion of said actuating spring means, and is released as said actuator means forces said lug members off said shoulder portion.

8. An improved piezoelectric high voltage impact mechanism as claimed in claim 7, further including return spring means, which after actuation of said mechanism causes said lug members to return to their original position engaged with said shoulder portions so that the piezoelectric mechanism is prepared for another actuation.

9. An improved piezoelectric high voltage impact mechanism as claimed in claim 1, said actuator means further includes two protrusions on the periphery of the opening of said blind bore provided between said projections, and said housing further includes another two grooves for receiving said protrusions so that the actuator means can be retained in the housing means firmly and not rotate, due to the biasing force of said torsioned actuating spring means.

10. An improved piezoelectric high voltage impact mechanism as claimed in claim 8, wherein said return spring means exerts force directly on said actuating spring means through said hammer means.

11. An improved piexoelectric high voltage impact mechanism as claimed in claim 1, further including a washer with a ring member provided between said actuator means and the opening of said housing means.

* * * * *